US008162031B2

(12) United States Patent
Wechsler

(10) Patent No.: US 8,162,031 B2
(45) **Date of Patent: *Apr. 24, 2012**

(54) HIGH EFFICIENCY PLANT FOR MAKING STEEL

(75) Inventor: Richard Wechsler, Charlotte, NC (US)

(73) Assignee: Nucor Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/280,736

(22) Filed: Oct. 25, 2011

(65) Prior Publication Data

US 2012/0041587 A1 Feb. 16, 2012

Related U.S. Application Data

(63) Continuation of application No. 12/794,755, filed on Jun. 6, 2010, now Pat. No. 8,042,602.

(60) Provisional application No. 61/187,582, filed on Jun. 16, 2009.

(51) Int. Cl.
*B22D 11/16* (2006.01)

(52) U.S. Cl. ..... 164/452; 164/428; 164/480; 164/420; 164/418

(58) Field of Classification Search ..... 164/452, 164/428, 420, 480, 418
See application file for complete search history.

(56) References Cited

U.S. PATENT DOCUMENTS

2003/0196776 A1* 10/2003 Strezov et al. ..... 164/452
* cited by examiner

*Primary Examiner* — Jessica L Ward
*Assistant Examiner* — Erin Saad
(74) *Attorney, Agent, or Firm* — Hahn Loeser & Parks LLP

(57) ABSTRACT

A method of making steel comprising assembling a steelmaking furnace, a thin strip caster, and a mold caster, inputting to a computer data on demand for production output, raw materials, furnace availability and capacity, sequence schedules and through-put, capacities and variability, forecasting by processing by computer from the inputted data a production schedule for the steelmaking furnace, and sequence schedules for the thin strip and the mold casters as a function of molten metal availability, the thin strip and mold caster sequence schedules and through-put, and demand for production output, directing production of molten metal alternatively to the delivery systems of the thin strip caster and mold caster responsive to said forecasting, and varying during casting the rate of metal delivery through the delivery system of the thin strip caster responsive to molten metal availability and the mold caster through-put.

20 Claims, 6 Drawing Sheets

HIGH EFFICIENCY PLANT FOR MAKING STEEL

RELATED APPLICATION

This application is a continuation of and claims priority to and the benefit of U.S. patent application Ser. No. 12/794,755, filed Jun. 6, 2010, which claims priority to U.S. Provisional Patent Application 61/187,582, filed Jun. 16, 2009, the disclosures of both of which are incorporated herein by reference.

BACKGROUND AND SUMMARY

Most steel is now made by slab caster, billet caster, bloom caster or thin strip caster, which forms the steel into a semi-finished slab, billet or bloom product or a near-finished strip cast product. Each of these casting processes involves continuous delivery of molten metal to the caster during the casting sequence for full production by the caster. If production is disrupted during the cast in making semi-finished product in a slab, billet or bloom caster, considerable downtime is required to clean or change out the cast mold and place dummy bars to start a new cast. Further, one or more strands of a billet caster can become plugged during the cast slowing the through-put of molten metal by the caster. Although precautions are taken to avoid such disruptions during a cast, such disruptions need to be anticipated and plans set for response when such a disruption occurs. Disruptions in casting of near-finished strip on a roll caster, on the other hand, generally involve simply restarting the cast without downtime or by a rapid change out of the casting rolls and/or refractories and restarting the cast. No cleaning of the mold or placement of a dummy bar is required to restart casting in making strip by roll caster.

In the past, these various casters have been serviced typically by a melt shop employing electric arc furnaces (EAF) or basic oxygen furnaces (BOF) to make hot steel compositions for casting. For slab, billet and bloom casting, the molten metal may be delivered directly to the caster, or delivered through a ladle metallurgy furnace (LMF) where the composition of molten metal from the melt shop is trimmed for the casting operation. Degassing is also less commonly used with slab, billet and bloom casters, but for certain grades of low carbon steel and steel stainless steel (where vacuum-oxygen decarburization (VOD) is typically used) degassing is used for control of the gases in the molten metal composition in preparation for casting. On the other hand, because of the nature of the strip casting process, it has been found generally necessary in all steel grades to control the amount of gases in the molten steel and to trim the composition of the molten metal in an LMF before delivery to a thin strip caster. Unlike slab, billet and bloom casting, continuously casting thin strip into a near-finished product involves forming the basic microstructure of the steel in milliseconds rather than minutes. For this reason, generally the time lapse to prepare the steel composition for casting between delivery of molten metal from a melt shop to strip caster is considerably longer than the time needed to prepare such molten metal for delivery to a slab, billet or bloom caster.

Another difference between making billet, blooms and slab by continuous mold caster and making cast strip by continuous strip caster is the rate of metal through-put. Billet, bloom and slab casters have a relatively limited ability to vary the through-put rate of the mold caster. The exception is in multiple strand mold casters such as the billet caster where one or more strands can become plugged during a cast and an unscheduled through-put of molten metal correspondingly decreased. Otherwise there is less ability to increase or decrease production during a casting campaign than in a continuous strip caster. A continuous strip caster, on the other hand, can substantially increase and decrease molten metal through-put rate by varying casting speed or varying thickness of the cast strip or both. The thinner the strip produced and the faster the strip caster operates, the more molten metal that can be processed by the plant in a given period of time.

As a result, the production of molten metal by the metal shop was generally driven by the needs of the particular caster being serviced. The time between completion of the making of the molten metal and the delivery of the molten metal to the caster have been coordinated so that the molten metal from the furnace on delivery to the caster had sufficient latent heat that the melt would not prematurely cool and disrupt the casting campaign. For this reason, the melt shop typically had more capacity than necessary to service the needs of the serviced caster. Moreover, although the capacity of the melt shop had to take into account the interim ladle treatment requirements for casting operation, the capacity of the melt shop was not matched to the particular need of the caster being serviced except in a gross way. Accordingly, the efficiency of the steelmaking plant was generally below capacity of the melt shop and governed by the through-put of the serviced caster.

The difficulty is compounded by the quite different market demand for, and profitability of, the semi-finished long product from the billet or bloom caster, the semi-finished slab product from the slab caster, and the near-finished strip product from the thin strip casters. In general, the product from the strip caster is more profitable and in higher demand because the product competes with cold roll sheet (which is more expensive to make with the rolling sequences involved). By contrast, semi-finished billets, blooms and slab are more plentiful and typically require further processing to produce a marketable product. Thus, market demand and profit margin of long products and slabs are generally lower than for thin cast strip. Yet, the production demands in making billets, blooms, beam blank, and slabs by continuous casters, with the need to avoid disruption of the casting campaigns, are considerably greater and quite different from the production demands in making thin cast strip.

Disclosed is a steelmaking plant that takes advantage of the full capacity of the melt shop, and produces both finished thin cast strip and semi-finished billets, blooms or slabs. The present steelmaking plant balances the needs and advantages of a strip caster with the operational demands of a billet caster, bloom caster or slab caster to produce both finished and semi-finished steel products in one plant and take use of the full capacity of the melt shop servicing the casters.

Disclosed is a method of making steel comprising the steps of:

(a) assembling a steelmaking furnace capable of melting and making molten metal for delivery to a first metal delivery system and a second metal delivery system, (b) assembling a thin strip caster capable of continuous casting of steel strip having a thin strip production output, the thin strip caster comprising a pair of casting rolls having a nip there between for delivery of thin strip downwardly there from, and the first metal delivery system capable of providing molten metal forming a casting pool between the casting rolls above the nip with side dams adjacent the ends of the nip to confine the casting pool, (c) assembling a mold caster capable of continuous casting of steel semi-finished products having a semi-finished production output, the mold caster comprising a casting mold capable of producing one or more strands and having the second metal delivery system capable of introducing molten metal into the casting mold, (d) inputting to a computer data on raw materials for the steelmaking furnace, the steelmaking furnace availability and capacity for making molten steel, ladle treatment for casting in the thin strip caster and mold caster, thin strip caster and mold caster sequence schedules and through-put, capacities and variability of the thin strip caster and mold caster, and demand and/or customer requirements for thin strip production output and semi-finished production output, (e) forecasting by processing by the computer from the inputted data a production schedule for the steelmaking furnace and ladle treatment, sequence schedule for the thin strip caster, and sequence schedule for the mold caster as a function of molten metal availability for casting, the thin strip caster and mold caster sequence schedules and through-put, and the demand for thin strip production output and semi-finished production output, and (f) directing production of the molten metal from the steelmaking furnace and ladle treatment alternatively to the first metal delivery system of the thin strip caster and to the second metal delivery system of the mold caster responsive to said forecasting.

The steps of inputting the data to the computer and forecasting by processing by the computer may be done intermittently during steelmaking. Alternately, the steps of inputting the data to the computer and forecasting by processing by the computer may be done continually during steelmaking.

The steps of forecasting by processing by the computer and directing production of the molten metal from the steelmaking furnace takes into account changing the rate of metal delivery through the first metal delivery system and the second metal delivery system during casting.

The steps of forecasting by processing by the computer and directing production of the molten metal from the steelmaking furnace may take into account the variable speed of thin strip casting and/or capacity to vary the thickness of cast strip by the strip caster. Alternately or in addition, the steps of forecasting by processing by the computer and directing production of the molten metal from the steelmaking furnace may involve steps of determining a desired rate of metal delivery through the first metal delivery system to the strip caster as a function of the molten metal availability and a desired mold caster through-put rate, and selecting caster speed and strip thickness of the thin strip caster corresponding to the determined rate of metal delivery through the first metal delivery system to the strip caster, the determined rate of metal delivery through the second metal delivery system to the mold caster, or both. The ladle treatment may be done separately for the first metal delivery system and the second metal delivery system, or the ladle treatment may be done for the first metal delivery system and not for the second metal system as desired for the particular embodiment.

Specifically, the steps of forecasting by processing by the computer and directing production of the molten metal from the steelmaking furnace may include varying casting by the thin strip caster to provide molten metal to the second metal delivery system for continuous casting by the mold caster to avoid disruption of the casting by the mold caster during the casting sequence. Alternatively, the steps of forecasting by processing by the computer and directing production of the molten metal from the steelmaking furnace may include varying the mold caster through-put as a function of the molten metal availability and the desired rate of metal delivery through the first metal delivery system to the strip caster.

The steps of forecasting by processing by the computer and directing production of the molten metal from the steelmaking furnace may take into account the ladle treatment of the molten steel for casting by ladle metallurgical furnace, degassing the molten metal, or a combination thereof.

The step of forecasting production schedules may include taking into account profitability in making semi-finished production output and thin strip production output. Alternately or in addition, profitability may be a function of customer requirements.

The steps of forecasting by processing by the computer and directing production of the molten metal from the steelmaking furnace may take into account market parameters for semi-finished production output and thin strip production output. The market parameters may include at least one selected from a group consisting of product prices, market indices, market capacity for the products, and orders for semi-finished production output and thin strip production output.

DETAILED DESCRIPTION OF THE DRAWINGS

Figure 1:
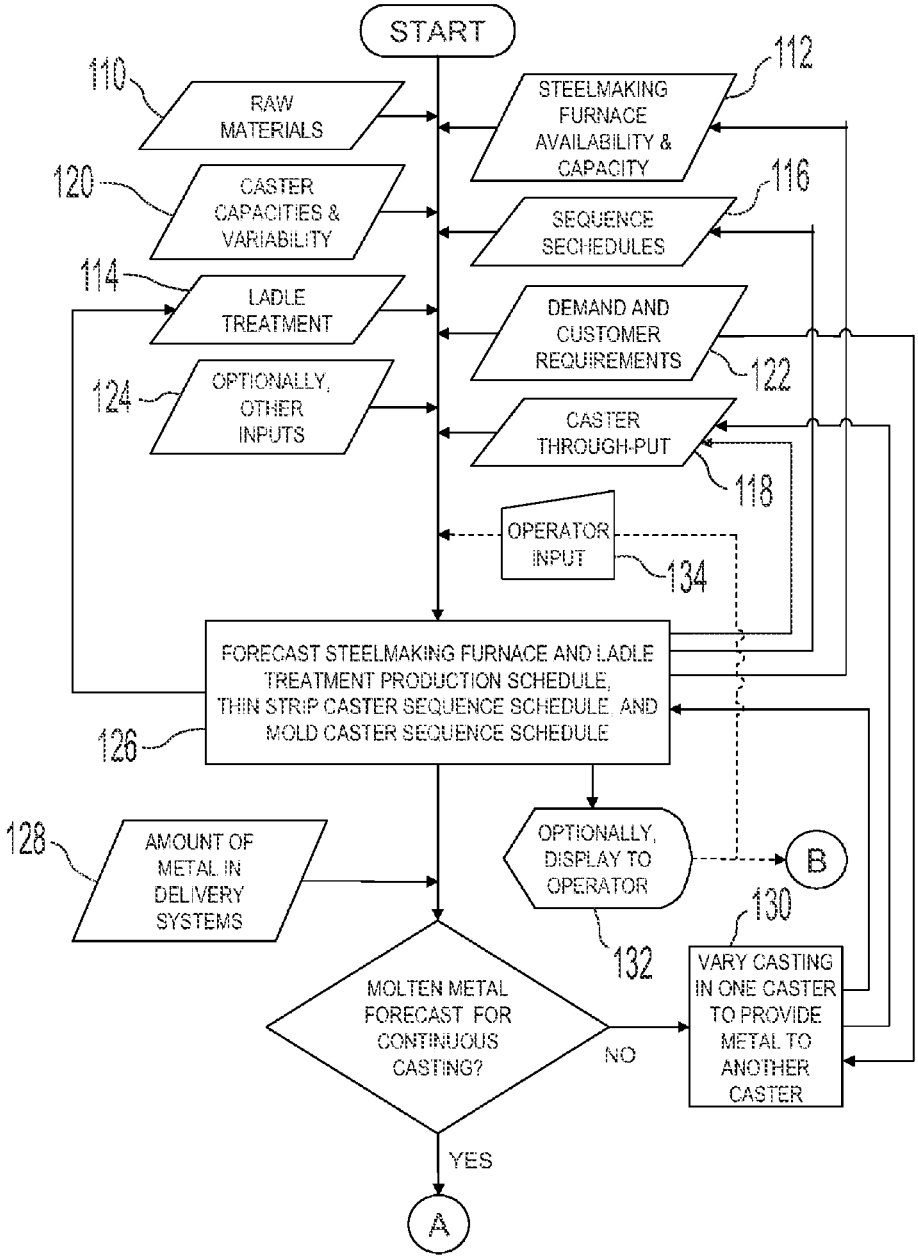
FIGS. 1 and 1A are flow charts illustrating embodies the presently disclosed method.
Figure 1A:
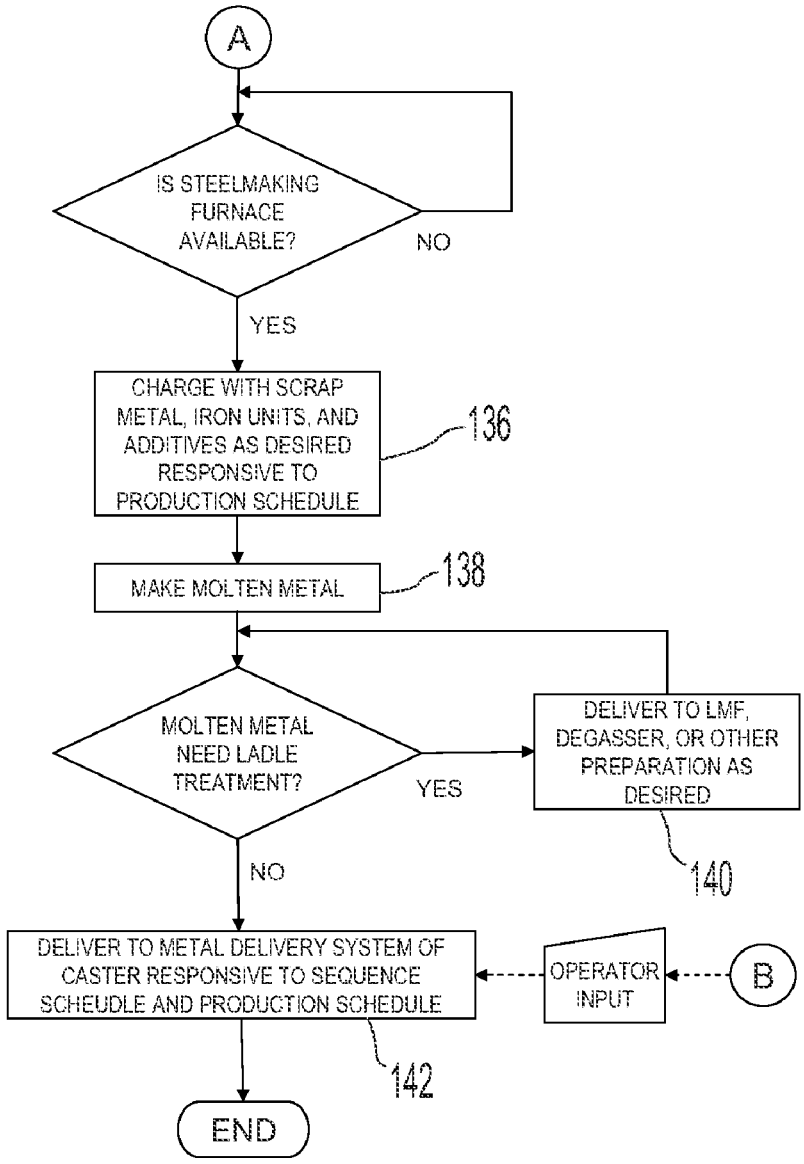

Referring now to FIGS. 1 and 1A, the flow charts illustrate an embodiment of the present method where data inputted to a computer includes data on raw materials for making steel composition in the steelmaking furnace 110, the steelmaking furnace availability and capacity for making molten steel 112, ladle treatment for strip casting or strip and mold casting 114, thin strip caster and mold caster sequence schedules 116, caster through-put 118, caster capacities and variability 120, and demand and customer requirements 122 for thin strip production output and semi-finished production output. Optionally, other data 124 may be input to the computer, such as other steelmaking specification parameters, business or market parameters, or other inputs. Note that the steel specification of the strip production for the strip caster likely are different from the steel specification desired for the billet, bloom or slab caster production. Accordingly, the differences in such steel specifications may be achieved by ladle treatment after production in the furnace in a vacuum tank degas ser (VTD) and/or LMF In any case, a computer-generated forecast 126 generates from the inputted data determining a production schedule for the steelmaking furnace and ladle treatment, sequence schedule for the thin strip caster, and sequence schedule for the mold caster as a function of molten metal availability for casting, the thin strip caster and mold caster sequence schedules 116 and through-put 118, and the demand 122 for thin strip production output and semi-finished production output. Note that the demand may include customer specifications for the strip product or semi-finished product, customer orders in hand, and/or market potential for the strip product, semi-finished product, or both.

The production schedules and sequence schedules are verified so the steelmaking furnace can provide molten metal to each caster without disrupting the casting sequences within the capacity of the steelmaking furnace. The schedules may include ladle treatment needed for the particular molten metal delivered to a strip caster or a strip caster and mold caster. The schedules take into account the time at which a ladle of molten metal is needed for continuous casting at each caster through the first or second caster metal delivery systems 128 and the through-puts 118 of each caster. If it is determined that a caster will deplete the amount of molten metal in its delivery system before another ladle of molten metal is available, alternatives and variations in the schedule are made to avoid disruption in the casting sequence. For example, the through-put of the strip caster may be decreased to lengthen the time before another ladle of molten metal is needed for continuous casting. Alternatively, the through-put of the mold caster may be varied to vary the time interval between ladle deliveries to the caster. The production schedules may take into account processing demand and customer or market requirements. For example, during casting, the through-put of the thin strip caster may be changed by selecting a different strip thickness selected taking into account customer and market demands for thin strip.

In any case, the steps of inputting data to the computer and forecasting by processing by the computer may be done continuously or intermittently during steelmaking. When the through-put of one or more casters is varied, or other inputs are changed, the production schedules and sequence schedules may be re-forecast to reflect the changes in variables. These forecast production schedules for the steelmaking furnace and ladle treatment, sequence schedule for the thin strip caster, sequence schedule for the mold caster, and other information may be displayed to an operator 132 so the operator may provide input 134 to the forecasting.

As shown in FIG. 1A, the steelmaking furnace may be charged with scrap metal, other iron units, and additives as desired 136 and the charge, or heat, is melted 138. At the end of the heat campaign, the molten metal is tapped from the steelmaking furnace into a ladle. The ladle may be delivered to degasser (e.g., VTD) and/or a ladle metallurgical furnace (LMF), as desired 140. Then the ladle is delivered to a thin strip caster or mold caster responsive to the forecasting 142. The operator may provide input to the step of directing production of the molten metal to the metal delivery system of a caster.

Figure 2:
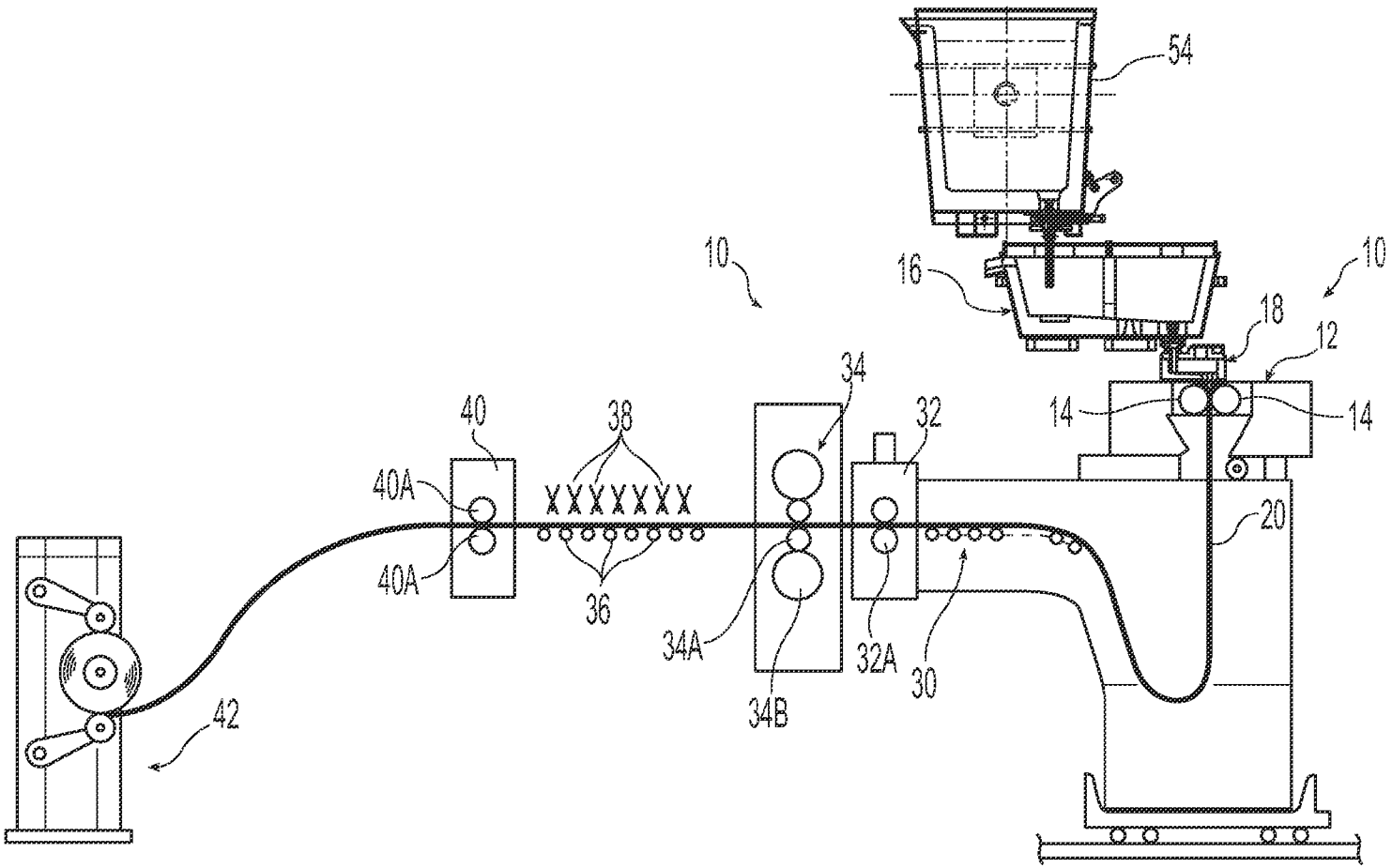
FIG. 2 is a diagrammatical view of a twin roll caster for use in the present method.

FIG. 2 is a schematic drawing illustrating a twin roll caster 10 capable of continuous casting of steel strip and having a strip production output. The thin strip caster 10 comprises a main machine frame 12 which supports a pair of laterally positioned casting rolls 14, which may have generally textured circumferential casting surfaces. The casting rolls 14 are counter-rotated by an electric, pneumatic or hydraulic motor and gear drive (not shown).

Referring to FIG. 2, thin cast strip 20 has a thickness less than about 5 millimeters and typically less than 2 millimeters. In continuous strip casting, molten (liquid) steel from a steelmaking ladle 54 is poured between the pair of counter-rotated laterally positioned casting rolls 14, which are internally cooled, so that metal shells solidify on the moving casting roll surfaces and are brought together at the nip between the casting rolls to produce a thin cast strip product. The term "nip" is used herein to refer to the general region at which the casting rolls 14 are closest together. The molten metal may be poured from the ladle 54 through a first metal delivery system to form a casting pool of molten metal supported on the casting surfaces of the rolls above the nip and extending along the length of the nip. This casting pool is usually confined between refractory side plates or dams (not shown) held in sliding engagement with the end surfaces of the casting rolls so as to form the casting pool. The pair of side closure plates or side dams may be held in place against the ends of the casting rolls by actuation of a pair of hydraulic cylinder units or other actuators (not shown).

Molten metal is supplied during a casting operation from the first metal delivery system to the thin strip caster to form the casting pool between the casting rolls 14 above the nip between the casting rolls, with side dams adjacent the ends of the nip to confine the casting pool. The metal delivery system may include the ladle 54 delivering molten metal to the tundish 16, then through a refractory ladle outlet shroud to a distributor or movable tundish 18, and from there through a metal delivery nozzle or core nozzle (not shown) positioned between the casting rolls 14 above the nip. The casting area above the casting pool includes the addition of a protective atmosphere to inhibit oxidation of the molten metal in the casting area.

The casting rolls 14 are internally water cooled so that metal shells solidify on the casting surfaces as the casting surfaces move into contact with and through the casting pool with each revolution of the casting rolls 14. The shells are brought together at the nip between the casting rolls to produce a solidified thin cast strip 20 delivered downwardly from the nip. The casting rolls 14 may be about 500 millimeters in diameter, or may be up to 1200 millimeters or more in diameter. The length of the casting rolls 14 may be up to about 2000 millimeters, or longer, in order to enable production of strip product of about 2000 millimeters width, or wider, as desired.

The thin cast strip 20, which passes across a guide table 30 to a pinch roll stand 32 comprising pinch rolls 32A. Upon exiting the pinch roll stand 32, the thin cast strip may pass through a hot rolling mill 34, comprising a pair of reduction rolls 34A and backing rolls 34B, where the cast strip is hot rolled to flatten and/or reduce the strip to a desired thickness. The rolled strip then passes onto a run-out table 36, where it may be cooled by contact with water supplied via water jets 38 (or other suitable means) and by convection and radiation. In any event, the rolled strip may then pass through a pinch roll stand 40 comprising a pair of pinch rolls 40A and to a coiler 42 where the strip is typically coiled into 20 to 30 ton coils.

Figure 3:
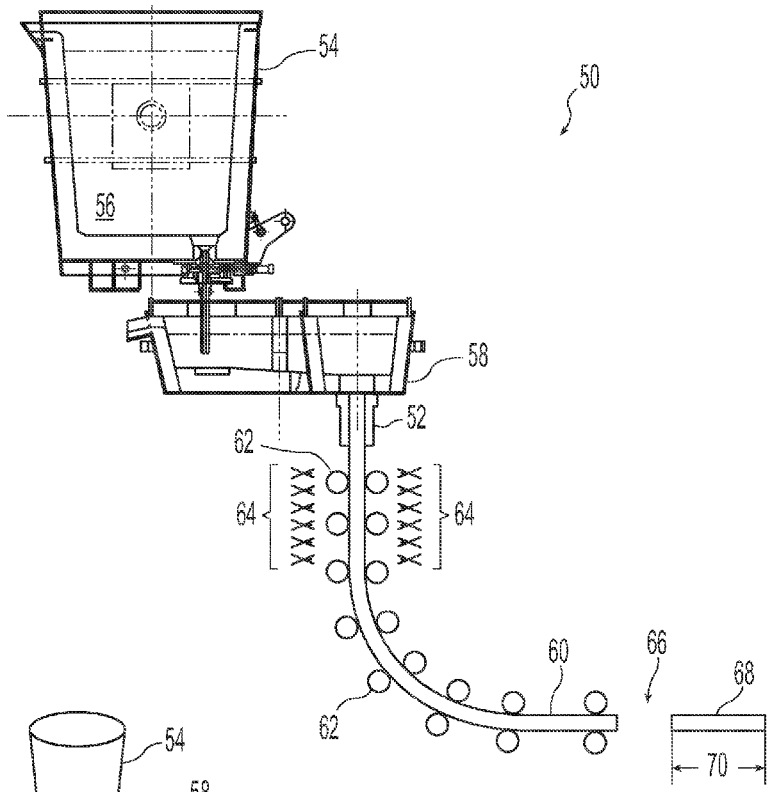
FIG. 3 is a diagrammatical view of a billet caster for use in the present method.
Figure 3A:
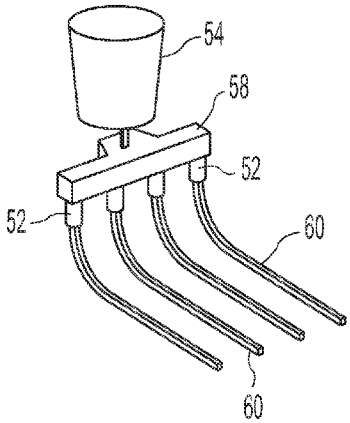
FIG. 3A is a partial diagrammatical perspective view of the billet caster of FIG. 3.

FIG. 3 is a schematic drawing illustrating a mold caster 50 such as a billet caster capable of continuous casting of steel long products and having at least one and typically between three and six, or more, strand production output. The mold caster 50 includes a second metal delivery system for the mold caster capable of introducing molten metal into the casting mold 52. The second metal delivery system may include a ladle 54 delivering molten steel 56 to a tundish 58, which directs the molten steel 56 to at least one casting mold 52 connected to the tundish 58, each casting mold 52 forming a cast strand 60. The casting mold 52 has a cross-sectional shape as desired to shape the cast strand 60, e.g., rectangular, circular, L-shape, rail or I-beam shape. Although described herein with reference to a billet caster, the mold caster 50 may be another semi-finished product caster such as a slab caster or bloom caster.

In any case, continuous semi-finished product casting may be made by a mold caster such as a slab caster, bloom caster or billet caster. Billets, for example, typically have a cross-sectional shape of approximately 250 millimeters width or smaller. Slabs typically have a rectangular cross sectional shape having a thickness between approximately 50 and 300 millimeters. Blooms, for example, typically have a cross sectional shape between about 300 and 600 millimeters in width. Bars typically have a cross sectional shape less than about 50 millimeters in width.

In casting long products or other semi-finished products, the molten (liquid) steel from the steelmaking ladle is poured into the tundish 58 through the second metal delivery system to the casting mold 52 for casting into semi-finished strands. The shape of the semi-finished strand is determined by the casting mold that receives the molten steel from the tundish. The steel is cast from the mold, which may be oscillated or vibrated, as a cast strand 60 having a molten inner core and an outer surface solidified by cooling. The strand is typically subjected to secondary cooling upon exiting from the mold until the entire strand is solidified. The strand is then cut to a desired length.

Referring now to FIG. 3, the cast strand 60 leaving the casting mold 52 enters a support roller assembly 62, where it may be cooled by contact with water supplied via water jets 64 (or other suitable means) and by convection and radiation to solidify into a solid metal strand substantially defined by the shape of the casting mold. The support roller assembly 62 directs the strand 60 toward a cutting point 66 as the strand cools to a solid form. During casting, water (or some other cooling fluid) may be circulated through the casting mold 52 to cool and solidify the surfaces of the cast strand 60. The strand 60 is cut at the cutting point 66 to provide a solid billet 68 having a predetermined length 70. After casting, the semi-finished products may be processed by subsequent operations such as surface finishing or forming, or other processing as desired.

Figure 4:
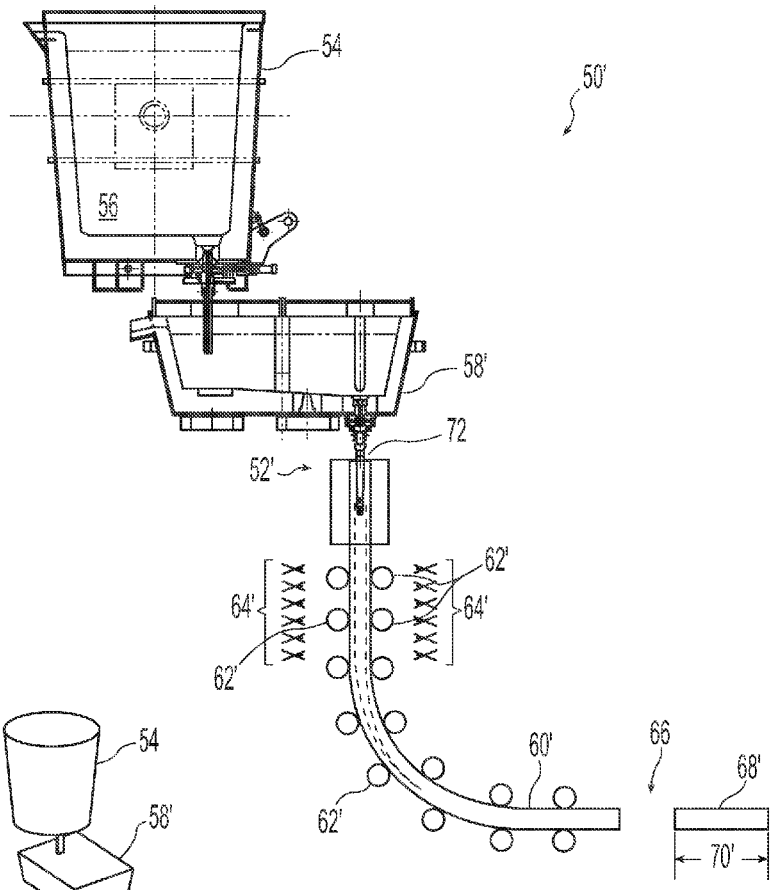
FIG. 4 is a diagrammatical view of a slab caster for use in the present method.
Figure 4A:
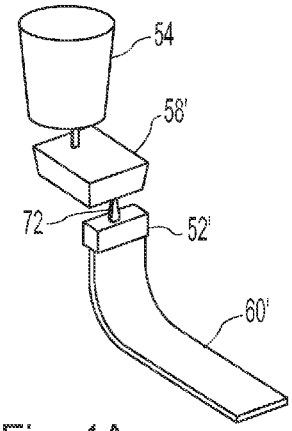
FIG. 4A is a partial diagrammatical perspective view of the slab caster of FIG. 4.

Certain mold casters, such as a slab caster, utilize a submerged entry nozzle between the tundish and the mold as shown in FIG. 4. The submerged entry nozzle 72 may be connected to a bottom of the tundish 58' which directs the molten steel 56 to the caster mold 52'. In the slab caster shown in FIG. 4, the cast strand 60' leaving an oscillating casting mold 52' enters support roller assembly 62', where it may be cooled by contact with water supplied via water jets 64' or other suitable means and by convection and radiation to solidify into a solid metal strand. The support roller assembly 62' directs the strand 60' toward a cutting point 66 as the strand cools to a solid form. The casting mold 52' may be cooled to cool and solidify the surfaces of the cast strand 60'. The strand 60' is cut at the cutting point 66 to provide a solid slab 68' having a predetermined length 70'.

Figure 5:
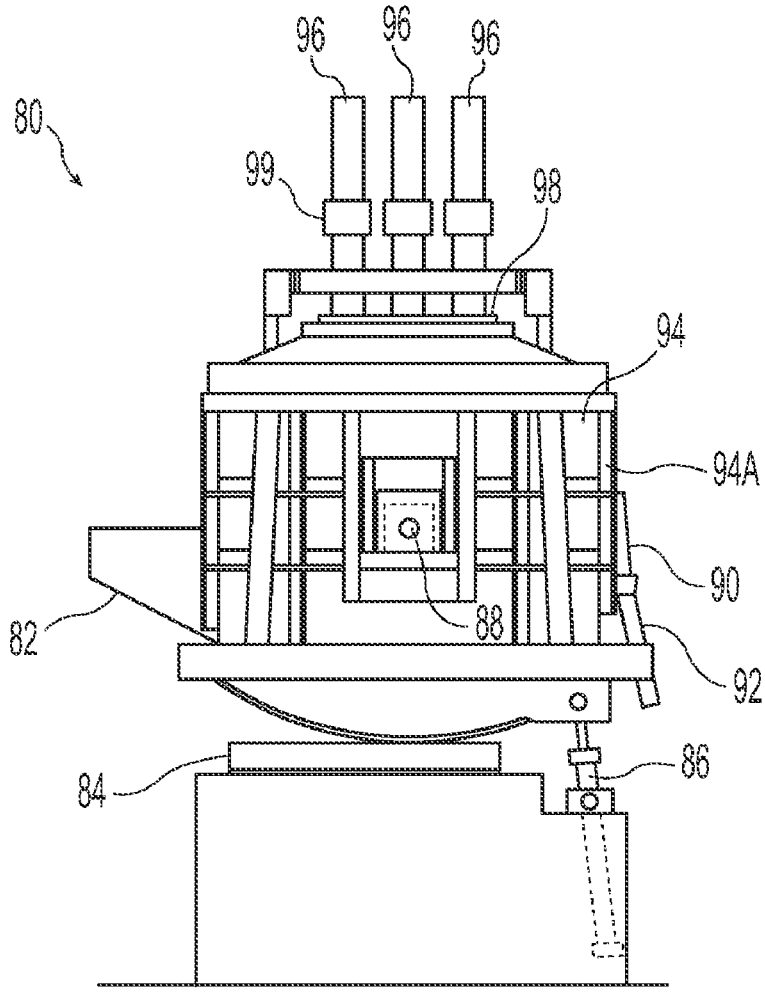
FIG. 5 is a schematic side view of an electric arc furnace for use in the present method.

Referring to FIG. 5, the mold caster and thin strip caster are supplied with molten metal from a steelmaking furnace 80 capable of melting and making molten metal, such as an electric arc furnace (EAF). Electric arc furnaces range in capacity from several tons up to about 180 tons or more, although for efficient continuous casting the capacity is generally between 60 and 120 tons. Electric arc furnaces typically melt steel by applying current through carbon electrodes to a charge of scrap metal and other iron units and additives.

The sidewalls above the slag line and the roof may include water-cooled panels 94 supported by a water-cooled cage 94A. Electrodes 96 extend through electrode ports 98 in the roof into the furnace. Electrodes 96 are supported by electrode holders 99 and an electrode mast, not shown. Transformers (not shown) supply the electrical current to the electrodes 96 and the steel melt in the electric arc furnace.

Oxy-fuel burners, not shown, may also be provided in the steelmaking furnace 80, and may be positioned below the slag line to assist in melting the scrap during the initial part of the steelmaking campaign. The oxy-fuel burners may supply exothermic energy to the furnace by combustion of a fuel/oxygen mixture flow through the oxy-fuel burners, and melt scrap or any other iron source charged to the steelmaking furnace. The oxy-fuel burners or separate oxygen lances may be used for providing oxygen to assist in steelmaking as explained below.

A heat cycle in the steelmaking furnace starts with charging the furnace with scrap metal, other iron sources, and additives as desired. Current is initiated through the electrodes and the electrodes lowered in the furnace. The current from the electrodes melts the charge materials as the electrodes are lowered through the charge. As noted, oxy-fuel burners may be used to assist in heating the charge. Also, oxygen may be injected into the molten steel through lances for decarburizing and slag foaming, as well as aiding in steel heating and refining.

FIG. 5 is a schematic drawing of an EAF, or steelmaking furnace 80, capable of melting and making molten metal for delivery to the delivery systems of the mold caster and the thin strip caster. The steelmaking furnace 80 is generally refractory lined to above the slag line, the level of molten steel. The EAF has a tap hole/spout 82 positioned capable of tapping molten steel at the end of a heat. The EAF may rest on a rocker rail 84, and is capable of being tilted by hydraulic cylinders 86 to discharge the molten metal from the furnace through the tap hole/spout 82. A slide door 88 may be positioned in the sidewall for charging the EAF and a backdoor 90 with a slag apron 92 may be positioned for discharge of the slag from the furnace. Although described herein with reference to an AC EAF furnace, the steelmaking furnace 80 may be an AC or DC EAF furnace, basic oxygen furnace, or other steelmaking furnace capable of melting and making molten metal for delivery to the delivery systems of the mold caster and the thin strip caster.

As the steel heat is completed, the molten metal is tapped through the tap hole/spout 82 and into the ladle 54. Before casting, the molten metal may be processed in a ladle metallurgical furnace (LMF). In the LMF, the composition of the molten metal may be tailored by adding additives and desired alloying elements. Alternatively or in addition, the molten metal may be further processed in a degasser, such as a vacuum tank degasser (VTD), vacuum-oxygen decarburization (VOD), or other degassing or preparation as desired. The molten metal may be further prepared by other processes as desired, such as argon-oxygen decarburization (AOD) or other preparation before being delivered to a caster.

One steelmaking furnace 80 is used to provide molten metal to a strip caster through a first metal delivery system and a mold caster through a second metal delivery system. For example, a 120 ton steelmaking furnace may have a capacity for making molten steel of about 1.1 to 1.2 million tons per year. One thin strip caster may have an annual through-put capacity of about 600,000 to 700,000 tons, while a billet caster, for example, may have an annual through-put capacity of about 500,000 tons. In the past, one steelmaking furnace had been used to provide molten metal for continuous casting by similar casters, such as a plurality of mold casters. The production of molten metal by the steelmaking furnace was therefore generally driven by the needs of the particular casters. When one steelmaking furnace serviced two or more casters in the past, the steelmaking furnace typically was not scheduled to the capacity of the steelmaking furnace and accommodate caster through-puts, duration of ladle treatment, and other variables without disrupting continuous casting by the casters serviced. We have found that one steelmaking furnace may be used with high efficiency based on the capacity of the furnace to provide molten metal for continuous casting by a thin strip caster and a mold caster using the presently disclosed method of casting steel.

A steelmaking furnace is provided in a steel casting facility capable of melting and making molten metal for delivery to a first delivery system and a second delivery system. At least one thin strip caster 10 may be assembled at the steel casting facility, the thin strip caster 10 being capable of continuous casting of steel strip having a thin strip production output, the thin strip caster 10 comprising a pair of casting rolls 14 having a nip there between for delivery of thin strip downwardly there from, the first delivery system capable of providing molten metal forming a casting pool between the casting rolls above the nip, with side dams adjacent the ends of the nip to confine the casting pool. At least one mold caster 50 may be assembled at the steel casting facility, the mold caster 50 being capable of continuous casting of steel semi-finished products having a specified production output, the mold caster comprising a casting mold 52 capable of producing one or more strand, the second delivery system capable of introducing molten metal into the casting mold.

As previously described, a 120 ton steelmaking furnace may be provided in a steel casting facility providing molten metal for delivery to the first metal delivery system of a thin strip caster and the second metal delivery system of a billet caster. The thin strip caster 10 capable of continuous casting of steel strip having a thin strip production output, and the billet caster 50 being capable of continuous casting of steel semi-finished products having a semi-finished production output. As discussed above, the steelmaking furnace may operate near capacity to provide about 600,000 or more tons of molten metal per year to the thin strip caster and about 500,000 or more tons of molten metal per year to the billet caster while maintaining continuous casting in the thin strip caster and billet caster as desired.

The mold caster 50 and the thin strip caster 10 each have a caster through-put, capacity and variability. The caster through-put is the rate of molten metal cast per unit of time, such as tons per hour. The caster capacity may also take into account the casting variability of the casters. The caster variability includes the range or variability in parameters such as casting speed, casting volume per minute, maintenance shutdown intervals, and other parameters. The caster variability also includes the ability of the caster to change parameters during casting. For example, the caster through-put is variable during casting by increasing or decreasing the rate of casting. In a multi-strand mold caster, if one strand becomes plugged, casting volume may be adjusted to continue casting in the remaining strands. For another example, in a twin roll caster, the thickness of the cast strip may be increased or decreased during casting and the speed of casting may be increased or decreased to vary the caster through-put.

During a casting sequence of continuous casting, molten metal flows from the ladle into the tundish. When the molten metal in the ladle is depleted, continuous casting continues for a time using the amount of molten metal in the tundish, and during that time, the empty ladle is replaced with another ladle containing molten metal. After the ladle is replaced, molten metal from the new ladle flows into and refills the tundish without disrupting the casting. For mold casters, disrupting a casting sequence typically results in an undesirable amount of tear-down, cleaning, and maintenance before casting can be restarted, possibly with use of a dummy bar. In these casters, providing molten metal flow through the metal delivery system to maintain continuous casting until the desired end of the casting sequence is highly desirable. On the hand, with twin roll casters, we have found that casting typically may be restarted after a casting sequence is disrupted by introducing molten metal to the delivery system without downtime, or by a rapid change out of core nozzles, side dams and/or casting rolls.

As discussed above, the steelmaking furnace heat campaign, or tap-to-tap cycle includes charging the furnace with scrap metal, other iron sources as desired, and desired additives, melting the charge, carbonizing, and tapping. For one steelmaking furnace to provide molten metal to more than one caster, the availability of molten metal from the steelmaking furnace needs to be coordinated with the depletion of the molten metal from the ladles servicing all casters. It is useful, if not necessary, to be able to prolong flow of molten metal to one caster while a subsequent ladle of molten metal is prepared and delivered to the other caster. As explained below, this can be done with twin roll casters by slowing the casting speed or decreasing the thickness of the cast strip, or both.

The molten metal for each caster and casting sequence may have certain specifications, such as steel composition, slag composition, oxygen and other gas content, and various caster and customer requirements. After tapping, the molten metal may be processed in a degasser, LMF and/or other ladle treatment to prepare and trim the molten steel for casting. The time needed for ladle treatment for casting after tapping is taken into account for molten metal availability for casting in the present method.

The composition of the molten metal from the steelmaking furnace is a function of the scrap metal, other iron sources, additives and gas content provided in the charge. The availability and composition of raw materials may be impacted by the capacity of the steelmaking furnace as well as the desired molten metal. Conversely, for example, scrap having high copper may not be useful for preparing certain grades of steel.

The molten metal for casting of steel on the mold caster and the twin strip caster may be forecast using sequence schedules. Sequence schedules may be forecast as a function of molten metal availability for casting, the thin strip through-put and the mold caster through-put, the thin strip sequence schedule and the mold caster sequence schedule, and production demand and customer or market requirements for thin cast strip and semi-finished production output by the casters, as discussed below. In forecasting the caster sequence schedules, it may be useful to schedule a caster with molten metal to cast at a desired casting rate in the mold caster, while the strip caster casts at a varying casting rate to correspond to molten metal availability. Further, to provide flexibility in scheduling to account for the unforeseen and contingencies, both the strip caster and the mold caster may utilize varying casting rates corresponding to molten metal availability. In any case, the thin strip caster sequence schedule and the mold caster sequence schedule may be forecast to balance and provide efficiency with variables of demand, customer requirements, and profitability of the combined thin strip and semi-finished production output.

Demand for the semi-finished production output and the thin strip production output may be based on customer orders, anticipated or forecasted market demand, inventory, and other requirements for the semi-finished production output and the thin strip production output, including amount of steel, delivery dates, and price. Additionally, the demand for the semi-finished production output and the thin strip production output is a function of customer requirements, which includes parameters such as strip thickness, strand dimensions, steel grade, steel composition, physical properties of the steel.

Using the available inputted data, the production schedule for the steelmaking furnace and ladle treatment, sequence schedule for the thin strip caster, and sequence schedule for the mold caster is forecast by computer. The presently disclosed process for making steel includes inputting to a computer data on raw materials for the steelmaking furnace, steelmaking furnace availability and capacity for making molten steel, ladle treatment for casting, thin strip caster and mold caster sequence schedules and through-put, capacities and variability, and customer requirements for thin strip production output and semi-finished production output. Then, forecasting by processing by computer from the inputted data a production schedule for the steelmaking furnace and ladle treatment, sequence schedule for the thin strip caster and sequence schedule for the mold caster as a function of molten metal availability for casting, thin strip caster and mold caster sequence schedules and through-put, and demand and customer requirements for thin strip production output and semi-finished production output. The computer processing is also able to account for delays and contingencies that occur during a campaign and vary the forecast accordingly as needed to provide high efficiency into production and profitability of the steelmaking furnace and the casters.

The forecast sequence schedule for each caster takes into account the sequence schedules of all casters that receive molten metal from the steelmaking furnace, and may re-forecast the sequence schedules during casting taking into account molten metal availability, casting through-put, and demand for the thin strip production output and the semi-finished production output. Inputting data to the computer and forecasting by processing by the computer may be done intermittently or continually during steelmaking.

The forecast sequence schedules for the casters, production schedule for the steelmaking furnace, ladle treatment, and casters as desired may be provided to an operator on a video display or a printout. The operator may also provide input to vary the forecasting as contingencies and scheduling changes arise. The operator may direct production of the molten metal from the steelmaking furnace alternatively to the first delivery system of the thin strip caster and to the second delivery system of the mold caster responsive to the forecasting. Additionally, the operator may direct charging of the steelmaking furnace responsive to the forecast production schedule for the steelmaking furnace, ladle treatment and casting.

Alternatively, directing production of the molten metal may be automated or semi-automated, and done directly by the computer forecast with some input as desired by the operator.

In any event, the forecasting of schedules and directing production of the molten metal from the steelmaking furnace may take into account changing the rate of metal delivery through the first metal delivery system of the thin strip caster and the second metal delivery system of the mold caster during casting. For example, the through-put of the mold caster may be increased or decreased a limited amount by increasing or decreasing the flow rate through the delivery system. Additionally, the through-put of the thin strip caster may be increased or decreased using the variable speed of thin strip casting and variability in thickness of cast strip by the strip caster. For example, to affect the casting through-put of the thin strip caster, the speed of casting may be increased or decreased during casting. Alternatively or in addition, the thickness of the cast strip may be varied during casting. The desired rate of metal delivery through the first delivery system to the strip caster may be determined as a function of the molten metal availability and a desired mold caster through-put rate. Then, the caster speed and strip thickness of the strip caster may be selected corresponding to the desired rate of metal delivery through the first delivery system. Alternately, a desired rate of metal delivery through the second delivery system to the mold caster may be determined as a function of the molten metal availability and a desired strip caster through-put rate. Then, the mold caster through-put may be selected corresponding to the desired rate of metal delivery through the second delivery system.

The rate of metal delivery through the first delivery system and the second delivery system may be varied during casting to provide molten metal for continuous casting. In one example, the casting by the thin strip caster may be varied to provide molten metal to the second delivery system for continuous casting by the mold caster. The desired rate of metal delivery through the first metal delivery system to the strip caster may be a function of demand and customer requirements for thin strip production output qualified by maintaining continuous casting. Additionally, the desired mold caster through-put rate may be selected as a function of demand and customer requirements for semi-finished production output and/or profitability. In this embodiment, the speed of the strip caster or the thickness of the strip produced by the strip caster may be varied to vary the through-put of the thin strip caster to maintain continuous cast through the mold caster. In addition or alternatively, a strip thickness may be selected as a function of market demand and customer requirements data.

The forecasting of schedules and directing production of the molten metal from the steelmaking furnace may take into account varying the mold caster through-put as a function of the amount of molten metal desired for delivery by the first delivery system to the strip caster. Alternately, the forecasting of schedules and directing production of the molten metal from the steelmaking furnace may take into account varying the strip caster through-put as a function of the amount of molten metal desired for delivery by the second delivery system to the mold caster.

The forecasting of schedules and directing production of molten metal may take into account the preparation of the molten steel for casting by degassing or ladle metallurgical furnace, or a combination thereof.

The forecasting of schedules and directing production of molten metal may take into account profitability of semi-finished production output and thin strip production output in the market place, or the profitability in making thin cast strip and semi-finished product made by the strip caster and the mold caster. Alternately or in addition, the profitability may be taken into account as a function of customer requirements.

More particularly, the forecasting of schedules and directing production of molten metal may take into account market parameters for thin strip and semi-finished products produced by the strip caster and the mold caster, such as steel prices, market indices, market steel capacity, and market steel demand for semi-finished production output and thin strip production output.

The computer may be a general purpose computer, a programmable logic controller, or other computing device adapted to receive the inputted data and process the data with desired algorithms to forecast by computer from the inputted data a production schedule for the steelmaking furnace, a sequence schedule for the thin strip caster, and a sequence schedule for the mold caster as a function of steelmaking furnace capacity, molten metal availability for casting, thin strip caster and mold caster sequence schedules and through-put, and demand for thin strip production output and semi-finished production output. The computer may be programmed, for example, to follow the flow chart of FIGS. 1 and 1A. Optionally, the computer and the process may enable operator inputs to any part or step of the process to vary the input data or adjust for contingencies and unforeseen.

While the invention has been illustrated and described in detail in the foregoing drawings and description, the same is to be considered as illustrative and not restrictive in character, it being understood that only illustrative embodiments thereof have been shown and described, and that all changes and modifications that come within the spirit of the invention described by the following claims are desired to be protected. Additional features of the invention will become apparent to those skilled in the art upon consideration of the description. Modifications may be made without departing from the spirit and scope of the invention.

What is claimed is:

1. A method of making steel comprising:

(a) assembling a steelmaking furnace capable of melting and making molten metal for delivery to a first metal delivery system and a second metal delivery system, (b) assembling a thin strip caster capable of continuous casting of steel strip having a thin strip production output, the thin strip caster comprising a pair of casting rolls having a nip therebetween for delivery of thin strip downwardly there from, the first metal delivery system capable of providing molten metal forming a casting pool between the casting rolls above the nip with side dams adjacent the ends of the nip to confine the casting pool, (c) assembling a mold caster capable of continuous casting of steel semi-finished products having a semi-finished production output, the mold caster comprising a casting mold capable of producing one or more strands, the second metal delivery system capable of introducing molten metal into the casting mold, (d) inputting to a computer data on demand for thin strip production output and semi-finished production output, steelmaking furnace availability and capacity for making molten steel, and thin strip caster and mold caster sequence schedules and through-put, capacities and variability, (e) forecasting by processing by computer from the inputted data a production schedule for the steelmaking furnace, a sequence schedule for the thin strip caster, and a sequence schedule for the mold caster as a function of molten metal availability for casting in the strip caster and mold caster, the thin strip caster and mold caster sequence schedules and through-put, and the demand for thin strip production output and semi-finished production output, and (f) directing production of the molten metal from the steelmaking furnace alternatively to the first delivery system of the thin strip caster and to the second delivery system of the mold caster responsive to said forecasting.

2. The method of making steel of claim 1, further comprising varying during casting the rate of metal delivery through the first delivery system responsive to molten metal availability and the mold caster through-put.

3. The method of making steel of claim 1, where the step of inputting to a computer data includes inputting data of raw materials for the steelmaking furnace.

4. The method of making steel of claim 1, where demand for the semi-finished production output and the thin strip production output is a function of one or more parameters selected from the group consisting of customer orders, anticipated or forecasted market demand, inventory, customer requirements for amount of steel output, customer requirements for delivery dates, customer requirements for steel price, customer requirements for strip thickness, customer requirements for strand dimensions, customer requirements for steel grades, customer requirements for steel compositions, and customer requirements for physical properties of steel.

5. The method of making steel of claim 1, where the step of inputting to a computer data includes inputting data of ladle treatment for casting, and the method further comprises forecasting by processing by computer from the inputted data a production schedule for ladle treatment.

6. The method of making steel of claim 5, where the steps of forecasting by processing by the computer and directing production of the molten metal from the steelmaking furnace take into account the preparation of the molten steel for casting by ladle metallurgical furnace, degassing the metal, or a combination thereof.

7. The method of making steel of claim 1, where the steps of inputting the data to the computer and forecasting by processing by the computer is done intermittently during steelmaking.

8. The method of making steel of claim 1, where the steps of inputting the data to the computer and forecasting by processing by the computer is done continually during steelmaking.

9. The method of making steel of claim 1, where the steps of forecasting by processing by the computer and directing production of the molten metal from the steelmaking furnace takes into account variable speed of thin strip casting and variability in thickness of cast strip by the thin strip caster.

10. The method of making steel of claim 1, where the steps of forecasting by processing by the computer and directing production of the molten metal from the steelmaking furnace takes into account changing the rate of metal delivery through the first delivery system and the second delivery system during casting.

11. The method of making steel of claim 1, where at least one of the steps of forecasting by processing by the computer and directing production of the molten metal from the steelmaking furnace comprises:

determining a desired rate of metal delivery through the first delivery system to the thin strip caster as a function of the molten metal availability for casting and a desired mold caster through-put rate; and selecting a caster speed and strip thickness of the thin strip caster corresponding to the determined rate of metal delivery through the first delivery system.

12. The method of making steel of claim 11, where the desired rate of metal delivery through the first delivery system is a function of demand for thin strip production output.

13. The method of making steel of claim 11, where the desired mold caster through-put rate is a function of demand for semi-finished production output.

14. The method of making steel of claim 1, where the steps of forecasting by processing by the computer and directing production of the molten metal from the steelmaking furnace include:

varying casting by the thin strip caster as a function of the amount of molten metal for the second delivery system for continuous casting by the mold caster.

15. The method of making steel of claim 1, where the steps of forecasting by processing by the computer and directing production of the molten metal from the steelmaking furnace include:

varying the mold caster through-put as a function of the amount of molten metal desired for delivery by the first delivery system to the thin strip caster.

16. The method of making steel of claim 1, where the steps of forecasting by processing by the computer and directing production of the molten metal from the steelmaking furnace include:

varying the thin strip caster through-put as a function of the amount of molten metal desired for delivery by the second delivery system to the mold caster.

17. The method of making steel of claim 1, where the steps of forecasting by processing by the computer and directing production of the molten metal from the steelmaking furnace include taking into account profitability in making the semi-finished production output and the thin strip production output.

18. The method of making steel of claim 17, where the steps of forecasting by processing by the computer and directing production of the molten metal from the steelmaking furnace takes into account profitability as a function of demand.

19. The method of making steel of claim 1, where the steps of forecasting by processing by the computer and directing production of the molten metal from the steelmaking furnace takes into account market parameters for the semi-finished production output and the thin strip production output by the mold and thin strip casters.

20. The method of making steel of claim 19, where the market parameters include at least one selected from a group consisting of steel prices, market indices, market steel capacity, and market steel demand for the semi-finished production output and the thin strip production output.

* * * * *